US005478259A

United States Patent [19]

Noschese

[11] Patent Number: 5,478,259

[45] Date of Patent: Dec. 26, 1995

[54] CARD EDGE CONNECTOR WITH COMBINED SHIELDING AND VOLTAGE DRAIN PROTECTION

[75] Inventor: Rocco J. Noschese, Wilton, Conn.

[73] Assignee: Burndy Corporation, Norwalk, Conn.

[21] Appl. No.: 218,737

[22] Filed: Mar. 28, 1994

[51] Int. Cl.[6] ..... H01R 13/648

[52] U.S. Cl. ..... 439/607; 439/108

[58] Field of Search ..... 439/92, 95, 101, 439/108, 607, 609, 636, 637, 629–635

[56] References Cited

U.S. PATENT DOCUMENTS

| | | | |
|---|---|---|---|
| 3,518,612 | 6/1970 | Dunman et al. . | |
| 3,973,817 | 8/1976 | Stalley et al. . | |
| 3,993,935 | 11/1976 | Phillips et al. | 317/101 C |
| 4,179,178 | 12/1979 | Bachman et al. . | |
| 4,241,381 | 12/1980 | Cobaugh et al. | 361/413 |
| 4,639,056 | 1/1987 | Lindeman et al. . | |
| 4,849,944 | 7/1989 | Matsushita | 371/21 |
| 4,889,495 | 12/1989 | Kimura | 439/60 |
| 4,950,172 | 8/1990 | Anhalt et al. | 439/108 |
| 4,969,824 | 11/1990 | Casciotti | 439/62 |
| 4,985,870 | 1/1991 | Faraci | 365/228 |
| 4,992,052 | 2/1991 | Verhoeven | 439/62 |
| 5,035,631 | 7/1991 | Piorunneck et al. | 439/630 |
| 5,040,999 | 8/1991 | Collier | 439/108 |
| 5,141,445 | 8/1992 | Little | 439/108 |

*Primary Examiner*—Larry I. Schwartz
*Assistant Examiner*—Hien D. Vu
*Attorney, Agent, or Firm*—Perman & Green

[57] ABSTRACT

A card edge connector having a housing, an electromagnetic shield, and a voltage drain contact directly fixedly attached to the shield. The voltage drain contact has a contact area located above the top of a center section of the housing. Electrical contact is made between the voltage drain contact and a voltage drain pad on a daughter board before the daughter board makes electrical contact with signal contacts in the housing. This avoids undesired surges of current.

19 Claims, 3 Drawing Sheets

CARD EDGE CONNECTOR WITH COMBINED SHIELDING AND VOLTAGE DRAIN PROTECTION

BACKGROUND OF THE INVENTION

1. Field of the Invention

The present invention relates to electrical connectors and, more particularly, to an electrical connector having a combined shielding and voltage drain protection assembly.

2. Prior Art

U.S. Pat. Nos. 4,985,870; 4,849,944 and 3,973,817 disclose ground pads on a printed circuit board at the outer ends of a card edge connection area that make electrical contact with a card edge connector before the rest of the contact pads make contact. U.S. Pat. No. 5,035,631 discloses a shielded card edge connector. U.S. Pat. No. 4,241,381 discloses ground pads above cut-outs on a printed circuit board. U.S. Pat. No. 4,889,495 discloses a connector with different length terminals to establish a contact sequence when a card is inserted.

SUMMARY OF THE INVENTION

In accordance with one embodiment of the present invention, a card edge connector is provided comprising a housing, an electromagnetic shield, and a voltage drain contact. The housing has a card edge receiving area. The electromagnetic shield surrounds an exterior of the housing. The voltage drain contact is directly fixedly attached to the shield and suitably positioned relative to the housing to contact a drain pad on a printed circuit board inserted into the card edge receiving area.

In accordance with another embodiment of the present invention, a card edge connector having a housing, signal contacts, and a protection assembly is provided. The protection assembly comprises an electromagnetic shield and a voltage drain contact. The electromagnetic shield surrounds the housing. The voltage drain contact is directly fixedly attached to two end portions of the shield to thereby attach the end portions to each other at a same attachment point of the voltage drain contact to the shield. The protection assembly provides both shielding protection for the signal contacts and voltage drain protection from a printed circuit board being inserted into the connector.

In accordance with another embodiment of the present invention, a card edge connector is provided comprising a housing, signal contacts, and electromagnetic shield, and a system for draining electricity from a daughter printed circuit board being inserted into the housing. The signal contacts are connected to the housing. The electromagnetic shield surrounds the housing. The system for draining electricity can drain electricity from a daughter printed circuit board before electrical contact is made between the signal contacts and signal pads on the daughter printed circuit board. The system includes a voltage drain contact directly attached to the shield at an end of the housing. The voltage drain contact has a contact area located above a top of a center section of the housing.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
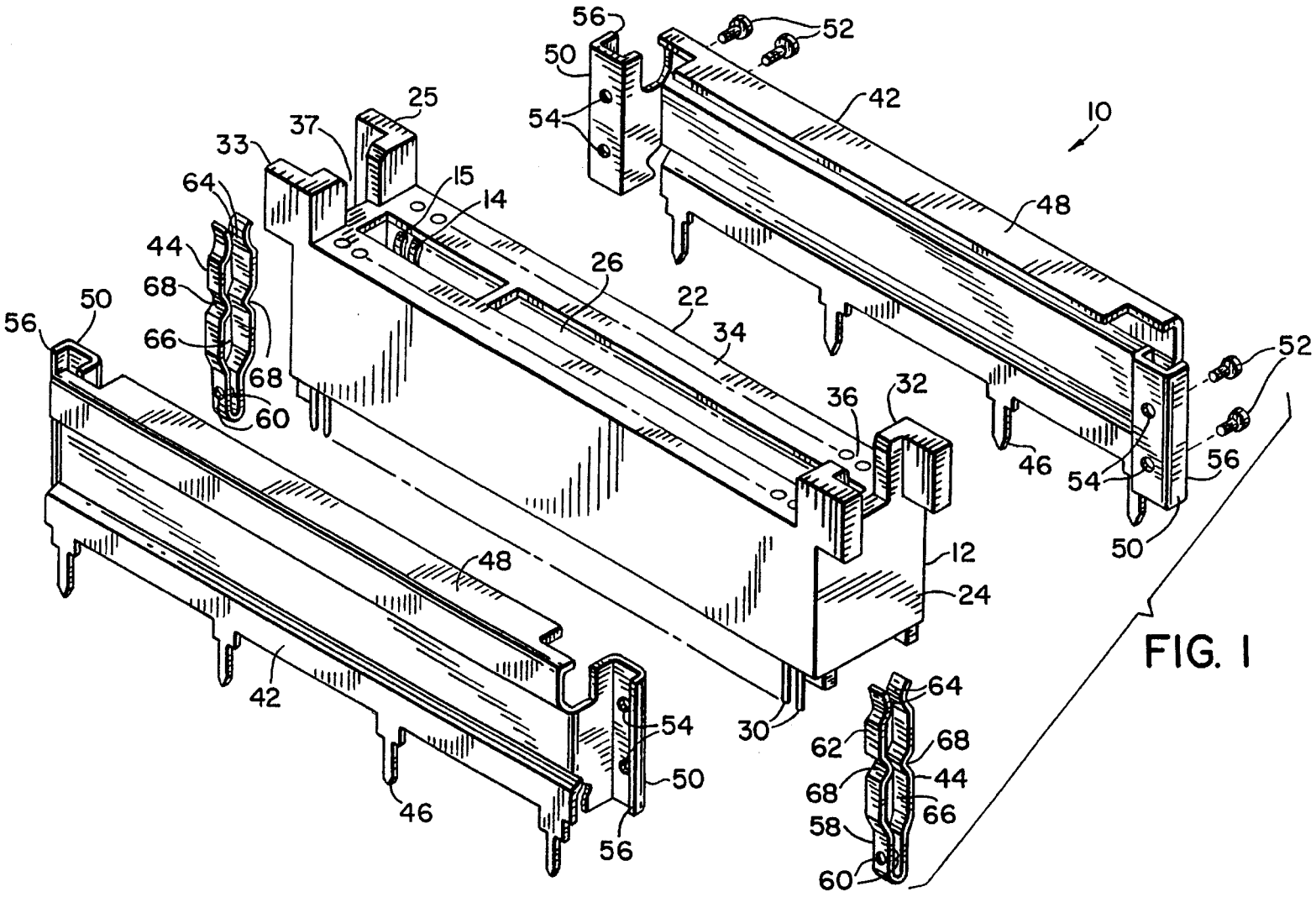
FIG. 1 is an exploded perspective view of an electrical connector incorporating features of the present invention.
Figure 2:
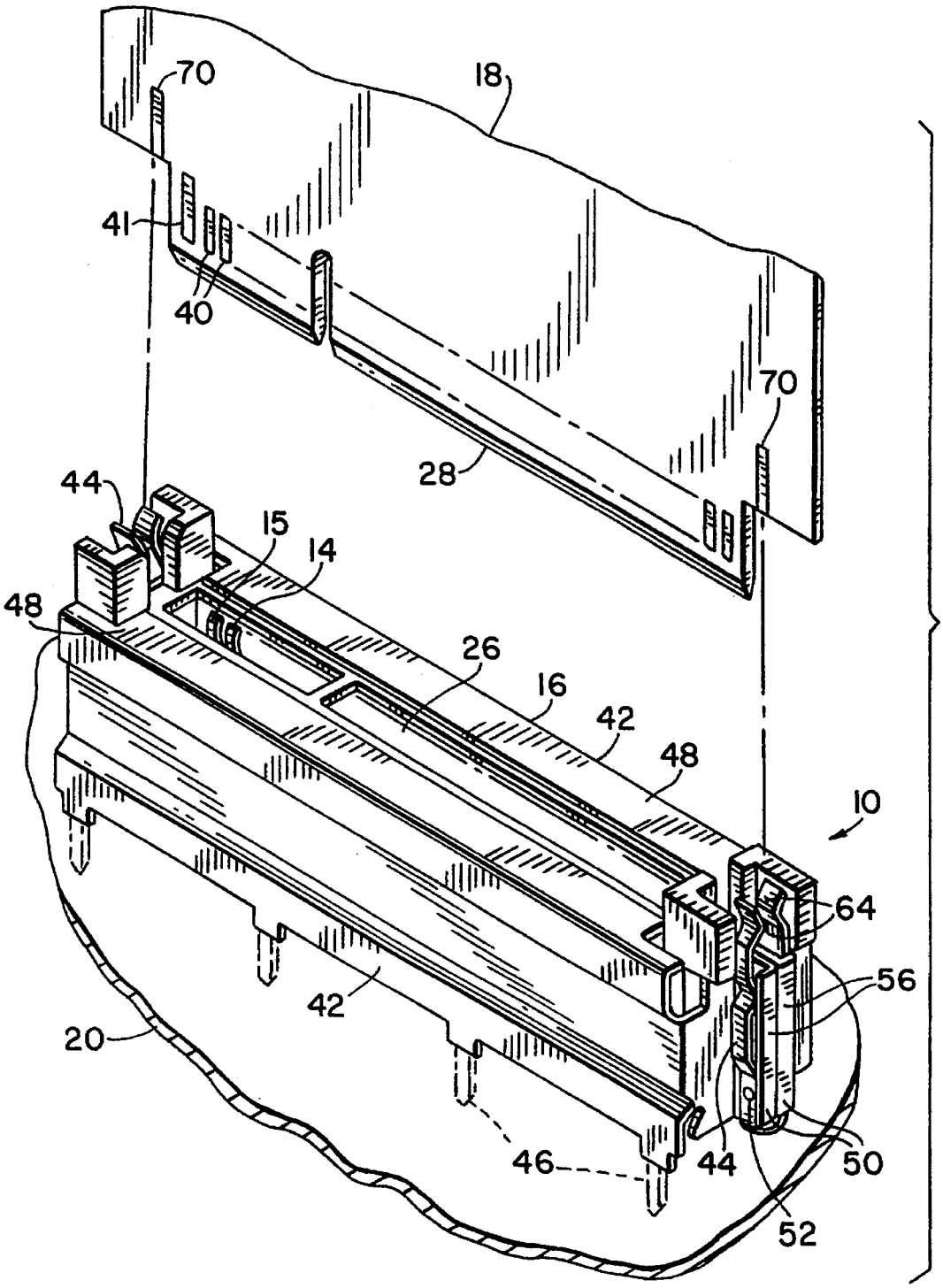
FIG. 2 is a perspective view of the connector shown in FIG. 1 attached to a mother printed circuit board showing how a daughter printed circuit board is inserted into the connector.
Figure 3:
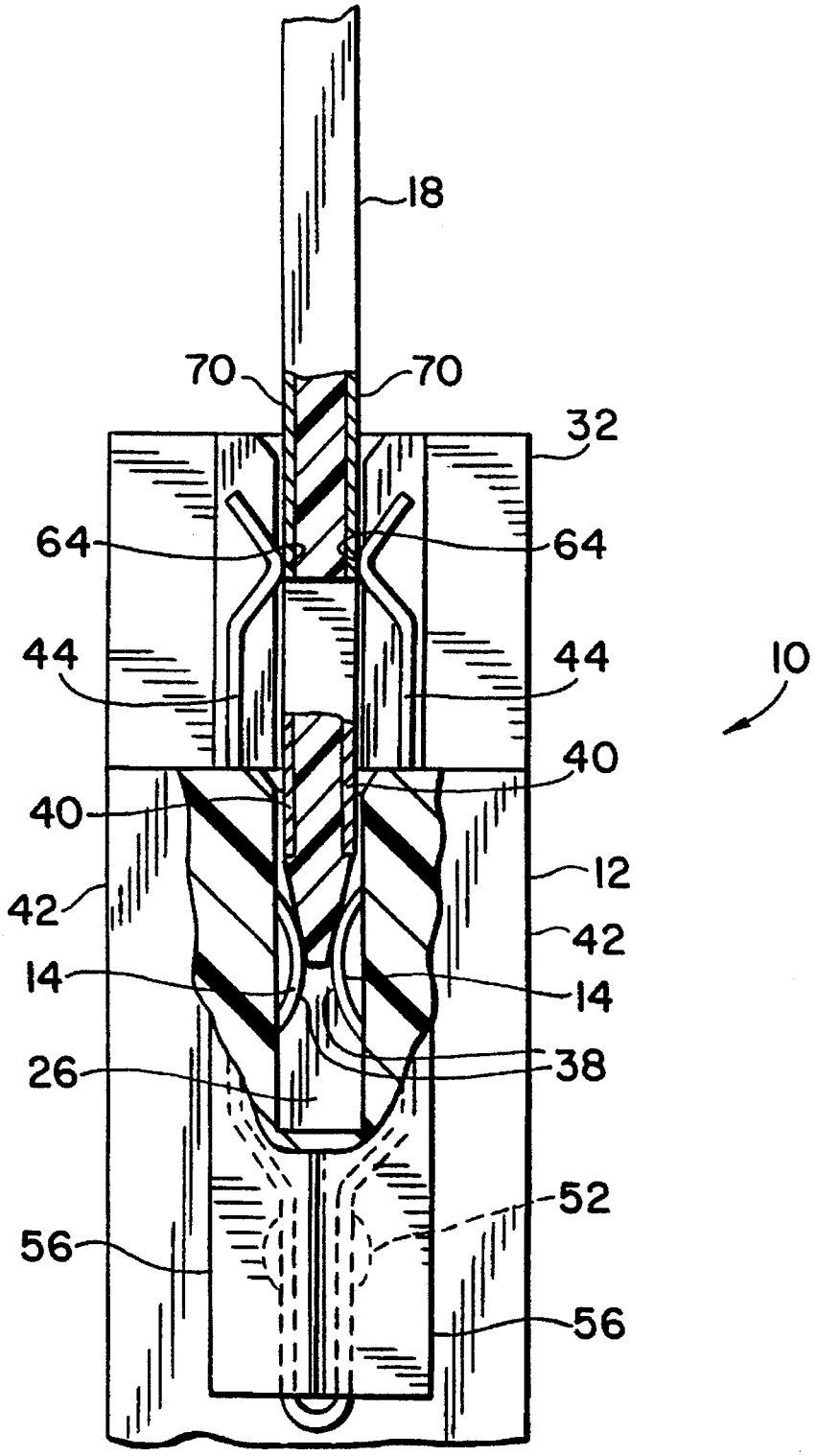
FIG. 3 is an end view with a partial cut away section of the electrical connector shown in FIG. 2 with the daughter printed circuit board partially inserted therein.

Referring to FIGS. 1–3, there is shown an electrical connector 10 incorporating features of the present invention. Although the present invention will be described with reference to the single embodiment shown in the drawings, it should be understood that the present invention can be used in a variety of different forms and types of alternate embodiments. In addition, any suitable size, shape, or type of elements or materials could be used.

The connector 10 generally comprises a housing 12, electrical signal contacts 14, power contacts 15, and a combined shielding and voltage drain protection assembly 16. The connector 10 is a card edge connector that is used to removably mechanically and electrically connect a daughter printed circuit board 18 to a mother printed circuit board 20. The housing 12 is preferably made of dielectric material, such as a molded plastic or polymer material. The housing 12 has a center section 22 and two end sections 24, 25. The center section 22 has a card edge receiving area 26 for removably receiving the edge connection area 28 of the daughter board 18. The contacts 14 and 15 are also housed in the center section 22 with tail ends 30 extending out of the bottom of the housing 12. The end sections 24, 25 form ends to the housing, but also include elevated sections 32, 33 that extend up above the top surface 34 of the center section 22. Slots 36, 37 are provided in the end sections 24, 25 to accommodate the daughter board 18.

The signal and power contacts 14, 15 can include any suitable type of spring contact. As is known in the art, the contacts 14, 15 have contact areas 38 in the receiving area 26 and solder tails 30. The contact areas 38 are adapted to make contact with signal pads 40 and power pads 41 on the edge connection area 28 of the daughter board 18 when the edge connection area 28 is inserted into the receiving area 26. The solder tails 30, in the embodiment shown, are through-hole solder tails. However, surface mount solder tails could also be used.

The protection assembly 16 generally comprises two half shield members 42 and two voltage drain contacts 44. The shield members 42 are connected to each other with the housing 12 sandwiched therebetween. The shield members 42 are made of an electrically conductive material and include through-hole solder tails 46, top sections 48, and end sections 50. The two shield members 42 are suitable sized and shaped to interlock with the housing 12 and then be connected to each other by rivets 52. The top sections 48 overlie the top surface 34 of the housing 12 without blocking the entrance to the card edge receiving area 26. The end sections 50 each have two rivet holes 54 for the rivets 52. Raised outer lips 56 are also provided to contain the voltage drain contacts 44. The end sections 50 are suitably sized and shaped such that, when the shield members 42 are located on opposite longitudinal sides of the housing 12, they contact the opposite end sections of the opposing shield member. During assembly, after the shield members 42 are properly located against the housing 12, the two upper rivets only are attached to the end sections 50. Then, the voltage drain contacts 44 are positioned and the two bottom rivets are attached. The two bottom rivets fixedly secure the voltage drain contacts 44 to the shield members 42.

The voltage drain contacts 44 are made of electrically conductive material and have a general U-shape. A first portion 58 of the contacts 44 has rivet holes 60. A second portion 62 of the contacts 44 has opposing contact areas 64. During assembly, the contacts 44 are positioned such that portions of both shield members 42 at both ends are located between the two arms of the contacts 44. The holes 60 are aligned with the bottom holes 54 and the bottom rivets 52 are then attached. This sandwiches portions of the end sections 50 between the arms of the contact 44. Widened area 66 of the contacts 44 are provided to accommodate the head and tail of the upper rivets. Two opposing spacer sections 68 are also provided on each contact 44 that contact the end sections 50 to space the contact areas 64 at a predetermined distance from each other. In an alternate embodiment, if it is desired to provide a connector with only shielding protection and not voltage drain protection, the voltage drain contacts 44 can merely be left off; the bottom rivets 52 merely connecting the shield members 42 to each other. In another alternate embodiment, fasteners other than rivets 52 could be used and, any suitable means to connect the voltage drain contacts 44 to the shield members and the shield members to each other could be used. In addition, more or less than two voltage drain contacts could be provided. More or less than two shield members could also be provided.

The solder tails 46 of the shield members 42 are electrically connected to a ground on the mother printed circuit board 20. Because the shield members 42 substantially surround the housing 12, the shield members 42 are able to intercept electromagnetic interference to prevent false signal generation or true signal distortion in the signal contacts 14. In addition, because the voltage drain contacts are electrically connected to the shield members 42, the protection assembly 16 is also able to drain voltage from the daughter board 18, as the daughter board is being inserted into the connector 10, before contact is made between signal and power contacts 14, 15 and signal and power pads 40, 41.

When the daughter board 18 is inserted into the connector 10, the card edge connection area 28 is inserted into receiving area 26. In addition to signal pads 40 and power pads 41, the daughter board 18 also has ground pads 70. The ground pads 70 are located separate from and on opposite ends of the card edge connection area 28. The contact areas 64 of the voltage drain contacts 44 are located a suitable distance above the contact areas 38 of the signal and power contacts 14, 15 such that, when the daughter board is inserted, the ground pads 70 make electrical contact with the drain contacts 44 before the signal pads 40 make contact with the signal contacts 14. This is illustrated in FIG. 3. This allows any residual electricity in the daughter board 18 to be removed. The slots 36, 37 in the housing end sections 24, 25 allow the daughter board 18 to be fully inserted into the connector 10. The housing end sections 24, 25 also protect the second portion 62 of the drain contacts 44. Raised outer lips 56 on the shield member end sections 50 keep the drain contacts properly positioned on the connector. Because the drain contacts 44 are fixedly connected to the shield members 42 only by the bottom rivets 52, a sufficient distance is provided between the bottom rivets 52 and the contact areas 64 to allow the arms of the drain contacts 44 to be resiliently deflected outward by the inserted mother board 18 without permanent deformation.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A card edge connector comprising:

a housing having a card edge receiving area;

an electromagnetic shield surrounding an exterior of the housing; and a voltage drain contact directly fixedly attached to the shield and suitably positioned relative to the housing to contact a ground pad on a printed circuit board inserted into the card edge receiving area, wherein the voltage drain contact has a portion located above the card edge receiving area and at a side end of the housing past an end of the card edge receiving area.

2. A connector as in claim 1 wherein the shield comprises two half members that sandwich the housing therebetween.

3. A connector as in claim 2 wherein the voltage drain contact is connected to mating ends of the two half members.

4. A connector as in claim 1 wherein the voltage drain contact has a receiving area for receiving a portion of a printed circuit board therein.

5. A connector as in claim 1 wherein the shield has through-hole solder tails extending therefrom.

6. A connector as in claim 1 wherein the connector comprises two voltage drain contacts, one at each end of the housing.

7. A card edge connector having a housing, signal contacts, and a protection assembly, the protection assembly comprising:

an electromagnetic shield surrounding the housing; and a voltage drain contact directly fixedly attached to two end portions of the shield to thereby attach the end portions to each other at a same attachment point of the voltage drain contact to the shield, wherein the protection assembly provides both shielding protection for the signal contacts and voltage drain protection from a printed circuit board being inserted into the connector.

8. A connector as in claim 7 wherein the shield is comprised of two half members that sandwich the housing therebetween.

9. A connector as in claim 8 wherein the protection assembly has two voltage drain contacts; one at each end of the housing.

10. A connector as in claim 7 wherein the voltage drain contact has a first portion that sandwiches the end portions therein and a second portion adapted to receive a portion of a printed circuit board therein.

11. A connector as in claim 10 wherein the second portion is located above the signal contacts.

12. A connector as in claim 7 wherein the shield has through-hole solder tails.

13. A connector as in claim 7 wherein the shield has means to interlock the shield with the housing.

14. A card edge connector comprising:

a housing;

signal contacts connected to the housing;

an electromagnetic shield surrounding the housing;

and a system for draining electricity from a daughter printed circuit board being inserted into the housing before electrical contact is made between the signal contacts and signal pads on the daughter printed circuit board, the system including a voltage drain contact directly attached to the shield at a side end of the housing past an end of a card receiving area, the voltage drain contact having a contact area located above a top of a center section of the housing.

15. A connector as in claim 14 wherein the connector comprises two voltage drain contacts; one at each end of the housing.

16. A connector as in claim 14 wherein the shield comprises two shield members that are directly attached to each other and sandwich the center section of the housing therebetween.

17. A connector as in claim 14 wherein the voltage drain contact has a first portion fixedly connected to the shield and a second portion with the contact area having two opposing spring contact surfaces forming a receiving area for receiving a portion of the daughter printed circuit board.

18. A connector as in claim 14 wherein the voltage drain contact has a general U-shaped configuration with portions of ends of the shield being sandwiched inside the general U-shaped configuration.

19. A connector as in claim 18 wherein the voltage drain contact has two opposing spring contact areas and two spacer sections that contact the shield to space the contact areas at a predetermined distance from each other.

* * * * *